US007682662B2

(12) United States Patent
Sasaki

(10) Patent No.: US 7,682,662 B2
(45) Date of Patent: Mar. 23, 2010

(54) PAINTED GOLF BALL AND PROCESS FOR PREPARING THE SAME

(75) Inventor: Takashi Sasaki, Kobe (JP)

(73) Assignee: SRI Sports Ltd., Kobe (JP)

( * ) Notice: Subject to any disclaimer, the term of this patent is extended or adjusted under 35 U.S.C. 154(b) by 664 days.

(21) Appl. No.: 11/598,014

(22) Filed: Nov. 13, 2006

(65) Prior Publication Data

US 2007/0117654 A1 May 24, 2007

(30) Foreign Application Priority Data

Nov. 24, 2005 (JP) ..... 2005-339393

(51) Int. Cl.
*A63B 37/14* (2006.01)
*A63B 37/00* (2006.01)
*C09D 175/00* (2006.01)

(52) U.S. Cl. ..... 427/302; 427/316; 427/333; 427/393.5; 427/412.1; 428/423.1; 428/423.3; 428/424.2

(58) Field of Classification Search ..... None
See application file for complete search history.

(56) References Cited

U.S. PATENT DOCUMENTS 4,871,589 A * 10/1989 Kitaoh et al. ..... 427/322
5,578,675 A * 11/1996 Mormile et al. ..... 524/589
5,728,432 A * 3/1998 Imashiro et al. ..... 427/389.8
5,866,715 A * 2/1999 Tsai ..... 560/302
6,255,382 B1 * 7/2001 Hamada et al. ..... 524/591
6,509,410 B2 1/2003 Ohira et al.
7,524,539 B2 4/2009 Ohira
2001/0034398 A1 10/2001 Ohira et al.
2002/0183455 A1 * 12/2002 Gray et al. ..... 525/242
2004/0052970 A1 3/2004 Ohira
2004/0053056 A1 * 3/2004 Rardon et al. ..... 428/423.1
2004/0116623 A1 * 6/2004 Isogawa et al. ..... 525/453
2006/0084757 A1 * 4/2006 Isogawa et al. ..... 524/591
2006/0178471 A1 * 8/2006 Sasaki et al. ..... 524/591

FOREIGN PATENT DOCUMENTS

AU 694540 B 3/1996
JP 2-11095 Y2 3/1990
JP 8-71177 A 3/1996
JP 2001-271027 A 10/2001
JP 2004-130111 A 4/2004

* cited by examiner

*Primary Examiner*—David Buttner
(74) *Attorney, Agent, or Firm*—Birch, Stewart, Kolasch & Birch, LLP

(57) ABSTRACT

The object of the present invention is to provide a golf ball having a paint film which is obtained from an environment-friendly aqueous paint and is excellent in the adhesion and the wear-resistance.

The gist of the present invention lies in improving the adhesion between the paint film obtained from the aqueous polyurethane paint and the surface of the golf ball body by first applying the aqueous liquid of the aqueous polycarbodiimide on the surface of the golf ball body, subsequently forming the primer layer comprising the aqueous polycarbodiimide, and then applying the aqueous polyurethane paint to form the paint film, while reducing the amount of solvent used in the aqueous paint for applying on the golf ball by using the polycarbodiimide liquid and the aqueous polyurethane paint.

20 Claims, No Drawings

PAINTED GOLF BALL AND PROCESS FOR PREPARING THE SAME

BACKGROUND OF THE INVENTION

1. Field of the Invention

The present invention relates to a painted golf ball and a process for preparing the same, more particularly to a golf ball having a paint film using an environment-friendly aqueous paint.

2. Description of the Related Art

A conventional golf ball has a paint film on the surface of the golf ball body. The paint film is formed to prevent the deterioration of the golf ball body due to the exposure of the sun light and the weather, as well as to impart a gloss to the golf ball body, thereby improving the appearance thereof.

It is required for the paint film to have adhesion against the impact, since the golf ball is repeatedly used and hit. Especially, since hitting the golf ball deforms the golf ball body, the paint film is likely to peel off in the case that the paint film covering the golf ball body does not follow the deformation of the golf ball body. In recent years, it has been expected to reduce the usage of the solvent-borne paint in view of the environmental problems, and an aqueous paint has been studied to replace the solvent-borne paint used for the golf ball. For example, Japanese unexamined patent publication No. H08-71177 discloses a golf ball where an aqueous polyurethane dispersion having a carboxyl group crosslinked with a carbodiimide compound is painted. Japanese utility publication No. H02-11095 discloses a golf ball where a high molecular weight of an aqueous polyurethane dispersion is coated.

SUMMARY OF THE INVENTION

However, the carbodiimide compound disclosed in Japanese patent publication No. H08-71177 is diluted with a solvent, and thus it is impossible to reduce an amount of the solvent used in the paint, as long as the above carbodiimide compound is used. Japanese utility publication No. H02-11095 discloses ethylene imine as a crosslinking agent for the high molecular weight of the polyurethane, but the usage of ethylene imine is not preferred from the view point of safety and health, since ethylene imine is mutagen. Further, a golf ball having a paint film made from the aqueous paint tends to be inferior to a golf ball having a paint film made from the solvent-borne paint in terms of the adhesion.

The present invention has been achieved in view of the above circumstances. The object of the present invention is to provide a golf ball having a paint film which is obtained from an environment-friendly aqueous paint and is excellent in the adhesion and the wear-resistance, and a method for manufacturing thereof.

The present invention provides a method for preparing a painted golf ball, comprising, coating an aqueous polycarbodiimide liquid and subsequently an aqueous polyurethane paint on a surface of a golf ball body. In one preferred embodiment of the present invention, the aqueous polycarbodiimide liquid coated on the surface of the golf ball body is dried before the aqueous polyurethane paint is coated.

The present invention also provides a painted golf ball comprising, a golf ball body, a primer layer comprising an aqueous polycarbodiimide covering a surface of a golf ball body, a paint film covering the primer layer, wherein the paint film is formed by applying an aqueous polyurethane paint.

More specifically, in the present invention, the aqueous liquid of the aqueous polycarbodiimide is first coated on the surface of the golf ball body to form the primer layer comprising the aqueous polycarbodiimide, and subsequently the aqueous polyurethane paint is coated to form the paint film, thereby enhancing the adhesion between the paint film obtained from the aqueous polyurethane paint and the surface of the golf ball body as well as reducing the amount of the solvent used in the aqueous paint for coating the golf ball.

In the present invention, "aqueous" includes the meaning of "water soluble" and "water dispersible".

DESCRIPTION OF THE PREFERRED EMBODIMENT

First, the aqueous polyurethane paint and the aqueous liquid of the aqueous polycarbodiimide used in the present invention will be explained below.

The aqueous liquid of the aqueous polycarbodiimide used in the present invention (hereinafter simply referred to as "polycarbodiimide liquid" occasionally) is a liquid (water solution or water dispersion) of the aqueous polycarbodiimide having at least two carbodiimide groups in a molecular thereof. Preferably used is an aqueous liquid of an aqueous polycarbodiimide resin. The aqueous (water soluble or water dispersible) polycarbodiimide resin includes a resin having a hydrophilic segment and a segment consisting of a repeating unit having a carbodiimide group, as depicted by the following formula (1).

(1)

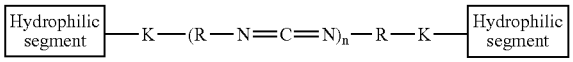

The aqueous polycarbodiimide resin represented by the above chemical formula (1) is obtained by using diisocyanate as a starting material. In formula (1), R is a residue where isocyanate groups are removed from diisocyanate. K means a bond formed by a reaction of an isocyanate group and a hydrophilic segment. "n" means an average degree of polymerization and is an integer ranging from 2 to 100. Examples of the hydrophilic segment in Formula (1) include a nonionic segment having an ethylene oxide chain, an anionic hydrophilic segment comprising a sulfonate, sulfate, and the like, or a cationic segment comprising a quaternary ammonium salt. Specific examples of the aqueous polycarbodiimide resin represented by formula (1) are aqueous tetramethyl xylylene carbodiimide and aqueous dicyclohexylmethane carbodiimide.

The aqueous polycarbodiimide preferably has a carbodiimide equivalent of 100 or more, more preferably 150 or more, even more preferably 250 or more, and preferably has a carbodiimide equivalent of 700 or less, more preferably 650 or less, even more preferably 600 or less. The use of the aqueous polycarbodiimide having the carbodiimide equivalent of 100 or more will enhance the adhesion-improving effect by forming a chemical bond between the paint film and the primer layer. In addition, the use of the aqueous polycarbodiimide having the carbodiimide equivalent of 700 or less will enhance the reactivity against the paint film, further improving the adhesion between the paint film and the primer layer. Herein, "carbodiimide equivalent" means a chemical formula weight (molecular weight) per one molar carbodiimide group of the aqueous polycarbodiimide.

In the present invention, the aqueous polycarbodiimide liquid, without limitation, preferably has a solid content (mass %)of 0.3% or more, more preferably 0.5% or more, further preferably 0.7% or more, while preferably has a solid content of 50% or less, more preferably 40% or less, further preferably 30% or less. When the solid content is too high, the amount of the aqueous polycarbodiimide attached to the surface of the golf ball body becomes so large that the surface becomes rough, which may eliminate the gloss of the golf ball obtained. On the other hand, when the solid content is too low, the amount of the aqueous polycarbodiimide attached to the surface of the golf ball body becomes too small to obtain an adhesion-improving effect of the paint film. Examples of the aqueous liquid of the aqueous polycarbodiimide resin are water-dispersible type "Carbodilite E-01, E-02, and E-03A (nonionic, solid content 40 wt %)" and water-soluble type "Carbodilite V-02, V-02-L2 and V-04" available from NISSHINBO INDUSTRIES, INC. Practically, these polycarbodiimide liquids do not contain a solvent substantially.

Examples of the aqueous polyurethane paint used in the present invention include a one-component aqueous polyurethane paint having a carboxyl group, or a curing paint containing an aqueous polyisocyanate and an aqueous polyol. In this invention, it is preferred to use the curing paint containing an aqueous polyisocyanate and an aqueous polyol. In an embodiment where a one-component aqueous polyurethane paint having a carboxyl group is used, the carboxyl group of the aqueous polyurethane having the carboxyl group reacts with the aqueous polycarbodiimide of the primer layer to form a chemical bond between the paint film and the primer layer, thereby enhancing the adhesion between the paint film and the primer layer.

Further, in a preferred embodiment where the curing paint containing the aqueous polyisocyanate and the aqueous polyol is used, the isocyanate group of the aqueous polyisocyanate and the aqueous polycarbodiimide in the primer layer react with each other, forming a chemical bond between the paint film and the primer layer to enhance the adhesion between the paint film and the primer layer. Further, when at least one of either the aqueous polyisocyanate or the aqueous polyol has a carboxyl group, the carboxyl group and the aqueous polycarbodiimide react with each other to further enhance the adhesion.

The one-component aqueous polyurethane paint having the carboxyl group used in the present invention is defined as an aqueous paint containing an aqueous polyurethane resin component having a high molecular weight to the extent that the polyurethane can form a film by itself, without using a curing agent and the like. As the aqueous polyurethane paint having the carboxyl group, the aqueous liquid (water solution or water dispersion) which is obtained by dissolving or dispersing an aqueous polyurethane component having an carboxyl group into water may be preferably used. The aqueous liquid of the aqueous polyurethane having the carboxyl group includes an anionic one which is soluble or dispersible into water by neutralizing the carboxyl group of the aqueous polyurethane having the carboxyl group with a base, a nonionic one which is obtainable by dispersing the aqueous polyurethane having the carboxyl group with high shear into water in the presence of a nonionic surfactant.

The polyisocyanate component which constitutes the aqueous polyurethane having the carboxyl group may include any polyisocyanate, as long as it has at least two isocyanate groups. Examples of the polyisocyanate component are an aromatic polyisocyanate such as 2,4-tolylene diisocyanate, 2,6-tolylene diisocyanate, or a mixture thereof (TDI), 4,4'-diphenylmethane diisocyanate(MDI), 1,5-naphthylene diisocyanate (NDI), 3,3'-bitolylene-4,4'-diisocyanate (TODI), xylylene diisocyanate (XDI), tetramethyl xylylene diisocyanate (TMXDI), and paraphenylene diisocyanate (PPDI); and an alicyclic or aliphatic polyisocyanate such as 4,4'-dicyclohexylmethane diisocyanate ($H_{12}MDI$), hydrogenated xylylene diisocyanate ($H_6XDI$), hexamethylene diisocyanate (HDI), isophorone diisocyanate (IPDI), and norbornene diisocyanate (NBDI). These may be used either alone or as a mixture of at least two of them. Among these, in view of weather resistance, non-yellowing type polyisocyanate (TMXDI, XDI, HDI, $H_6XDI$, IPDI, $H_{12}MDI$, NBDI and the like) are preferably used. The polyisocyanate may be used either alone or as a mixture of at least two of them.

The polyol constituting the aqueous polyurethane having the carboxyl group may have either low-molecular-weight of less than about 500 or high-molecular-weight of not less than about 500, as long as it has a plurality of hydroxyl groups. Examples of the low-molecular-weight polyols are a diol such as ethylene glycol, diethylene glycol, triethylene glycol, 1,3-butanediol, 1,4-butanediol, neopentyl glycol, and 1,6-hexanediol; and a triol such as glycerin, trimethylolpropane, and hexanetriol. Examples of the high-molecular-weight polyols are a polyetherpolyol such as polyoxyethylene glycol (PEG), polyoxypropylene glycol (PPG), and polyoxytetramethylene glycol (PTMG); a condensed polyesterpolyol such as polyethylene adipate (PEA), polybutylene adipate (PBA), and polyhexamethylene adipate (PHMA); a lactone polyesterpolyol such as poly-ϵ-caprolactone (PCL); a polycarbonatepolyol such as polyhexamethylenecarbonate polyol; and an acrylic polyol. Among them, preferably used is the polyol having a weight average molecular weight of not less than 50, more preferably not less than about 100, and having a weight average molecular weight of not more than 2000, more preferably not more than about 1000. The above polyol can be used individually or in combination of at least two of them.

The aqueous polyurethane having the carboxyl group may further include a polyamine component in addition to the above components. The polyamine component includes, for example, an aliphatic polyamine such as ethylenediamine, propylenediamine, and hexamethylenediamine; an aromatic polyamine such as tolylenediamine, xylylenediamine, and diaminodiphenylmethane; a cycloaliphatic polyamine such as diaminocyclohexylmethane, piperazine, and isophoronediamine; and a dihydrazide or a derivative thereof such as hydrazine, succinic hydrazide, adipic hydrazide, and phthalic dihydrazide. In addition, an alkanolamine such as diethanolamine and monoethanolamine can be used as either of the polyamine component or the low-molecular weight of polyol component.

The aqueous polyurethane having the carboxyl group preferably has an acid value of 10 mgKOH/g or more, more preferably 15 mgKOH/g or more, even more preferably 20 mgKOH/g or more, based on solids. The aqueous polyurethane having the acid value of 10 mgKOH/g or more provides the reaction site with the aqueous polycarbodiimide and thus the adhesion with the primer layer becomes higher. The upper limit of the acid value is not limited, but preferably 60 mgKOH/g, more preferably 50 mgKOH/g, even more preferably 40 mgKOH/g. When the acid number is larger than 60 mgKOH/g, the amount of the hydrophilic group (carboxyl group) becomes so large that the water resistance of the paint film obtained becomes lower.

Examples of the aqueous liquid of the polyurethane having the carboxyl group include, for example, Takelac W-615, W-6010, and W-6021 available from Mitsui Takeda Chemicals, Inc.

In the following, a curing paint containing the aqueous polyol and the aqueous polyisocyanate, which is preferably used in the present invention, will be explained. The curing paint forms the paint film by making a curing reaction between the aqueous polyol and the aqueous polyisocyanate to form a polyurethane.

The aqueous polyol used in the present invention has no limitation, as long as it has a hydrophilic segment or hydrophilic group and at least two hydroxyl groups. Examples of the aqueous polyol having a hydrophilic segment and at least two hydroxyl groups include polyethylene glycol(PEG), while the aqueous polyol having a hydrophilic group and at least two hydroxyl groups includes, for example, the aqueous polyol having the carboxyl group.

The aqueous polyol preferably has hydroxyl value of not less than 25 mgKOH/g, more preferably not less than 30 mgKOH/g, even more preferably not less than 35 mgKOH/g, and preferably has hydroxyl value of not more than 100 mgKOH/g, more preferably not more than 95 mgKOH/g, further preferably not more than 90 mgKOH/g. If the aqueous polyol has hydroxyl value of less than 25 mgKOH/g, the adhesion between the paint film and the golf ball body may be lowered. While if the aqueous polyol has hydroxyl value of more than 100 mgKOH/g, the curing reaction with the aqueous polyisocyanate takes a longer time, resulting in the lower productivity. The hydroxyl value is determined, for example, by the potentiometric titration, according to JIS-K1557.

The aqueous polyol preferably has a weight average molecular weight of 4,000 or more, more preferably 5,000 or more, even more preferably 6,000 or more, and preferably has a weight average molecular weight of 20,000 or less, more preferably 17,000 or less, even more preferably 15,000 or less. If the weight average molecular weight is less than 4,000, it takes a longer time to dry the paint, resulting in the lower productivity, while if the weight average molecular weight is more than 20,000, the hydroxyl value becomes relatively low, thus the adhesion between the paint film and the primer layer will be lowered. The molecular weight of the aqueous polyol is determined by Gel permeation chromatography using polystyrene as a standard material.

The aqueous polyol having a carboxyl group used in the present invention has no limitation, as long as the polyol is aqueous, has at least a carboxyl group, and at least two hydroxyl groups in a molecule. Examples of the aqueous polyol are an aqueous polyester polyol, an aqueous polyether polyol, an aqueous urethane polyol, an aqueous acrylic polyol, an aqueous alkyd resin, a polyvinyl alcohol, and a cellulose derivative such as hydroxyl ethylcellulose and carboxyl methylcellulose. The above aqueous polyol can be used individually or in combination of at least two of them. Among them, it is even more preferable to use the aqueous polyester polyol or the mixture of the aqueous polyester polyol and the aqueous acrylic polyol, because the aqueous polyester polyol improves the impact-resistance of the resulting urethane paint film and the aqueous acrylic polyol improves the weather resistance. More preferably, the aqueous polyol is the mixture of the aqueous polyester polyol and the aqueous acrylic polyol at the mass ratio of the aqueous polyester polyol: the aqueous acrylic polyol=4:1 to 10:1, since the resultant film is excellent in both mechanical properties and weather resistance.

The aqueous polyester polyol having a carboxyl group, as described above, may be either a water-soluble polyester polyol or water-dispersible polyester polyol, and the carboxyl group may be made aqueous by neutralization with the base. The aqueous polyester polyol having the carboxyl group can be produced, according to the method well-known for producing the conventional polyester polyol. For example, the aqueous polyester polyol can be obtained by the polycondensation between a (low molecular weight) polyol and a polybasic acid.

The carboxyl group for the aqueous polyester polyol can be introduced from either the polyol component or the polybasic acid component. A polyol component for introducing the carboxyl group into the polyester polyol includes, for example, dimethylol propionic acid, dimethylol butanoic acid, dihydroxyl propionic acid, or dihydroxyl succinic acid. The polyol component, other than the polyol component for introducing the carboxyl group, includes a well known polyol for preparing the polyester polyol. Examples of the well known polyol are a diol such as ethylene glycol, propylene glycol, 1,3-propanediol, 1,4-butanediol, 1,5-pentanediol, 3-methyl-1,5-pentanediol, 1,6-hexanediol, neopentyl glycol, diethylene glycol, triethylene glycol, tetraethylene glycol, dipropylene glycol, tripropylene glycol, 1,4-cyclohexanediol, and bisphenol A; or a triol such as glycerin and trimethylol propane. The above polyol can be used individually or in combination of at least two of them.

The polybasic acid component for introducing the carboxyl group into the polyester polyol includes, for example, trimellitic anhydride and pyromellitic anhydride. The polybasic acid, other than the polybasic acid for introducing the carboxyl group, includes a well known polybasic acid for preparing the polyester polyol. Examples of the well known polybasic acid are a dibasic acid such as succinic acid, adipic acid, azelaic acid, sebacic acid, dodecanedicarboxylic acid, maleic anhydride, fumaric acid, 1,3-cyclopentanedicarboxylic acid, 1,4-cyclohexanedicarboxylic acid, terephtalic acid, isophtalic acid, 1,4-naphtalenedicarboxylic acid, 2,5-naphtalenedicarboxylic acid, 2,6-naphtalenedicarboxylic acid, naphtalic acid (1,8-naphtalenedicarboxylic acid), and biphenyldicarboxylic acid. The above polybasic acid can be used individually or in combination of at least two of them.

The aqueous urethane polyol having a carboxyl group is not limited, as long as it has a urethane bond in the molecular chain thereof, at least a carboxyl group and a plurality of hydroxyl groups. The aqueous urethane polyol having a carboxyl group, for example, can be obtained by reacting the above aqueous polyester polyol with the polyisocyanate in such a molar ratio that the hydroxyl group of the polyol component is excess to the isocyanate group of the polyisocyanate.

Examples of the aqueous acrylic polyol having a carboxyl group include the product of copolymerization of (meth) acrylate having hydroxyl group with ethylenically unsaturated carboxylic acid such as (meth)acrylic acid, maleic acid, and itaconic acid.

Examples of the (meth)acrylate having a hydroxyl group are 2-hydroxyethyl (meth)acrylate, and hydroxypropyl (meth)acrylate. Examples of the other monomer component copolymerized into the acrylic polyol are well-known ethylenically unsaturated monomers such as methyl (meth)acrylate, ethyl (meth)acrylate, isopropyl (meth)acrylate and n-butyl (meth)acrylate.

The process for preparing the aqueous acrylic polyol is not limited, and is conducted by, for example, copolymerizing the ethylenically unsaturated monomer having a carboxyl group such as (meth)acrylic acid, neutralizing the carboxyl group with the base, or by emulsion-polymerizing the ethylenically unsaturated monomer containing (meth)acrylate having the hydroxyl group in the presence of the surfactant or soap-free polymerization.

The preparation of the aqueous polyol liquid having a carboxyl group is not limited, and, as described above, is conducted by neutralizing the carboxyl group with the base.

The base for neutralizing the carboxyl group includes, for example, a primary amine such as ammonia, methylamine, and ethylamine; a secondary amine such as diethanol amine, dimethyl amine, and diethyl amine; a tertiary amine such as triethyl amine and triethanol amine; a hydroxide of alkali metal such as sodium hydroxide and potassium hydroxide.

The aqueous polyol having the carboxyl group preferably has an acid number of 10 mgKOH/g or more, more preferably 15 mgKOH/g or more, and even more preferably 20 mgKOH/g or more, and preferably 50 mgKOH/g or less, more preferably 45 mgKOH/g or less, even more preferably 40 mgKOH/g or less. If the acid number is less than 10 mgKOH/g, the amount of the hydrophilic group(carboxyl group) is so small that the dispersibility and the solubility into water will be lowered. On the other hand, when the acid number is larger than 50, the amount of the hydrophilic group (carboxyl group) becomes so large that the water resistance of the paint film obtained will be lowered.

According to a preferred embodiment of the present invention, an aqueous polyol having the carboxyl group is used in the form of a liquid wherein the aqueous polyol is dissolved or dispersed in water. The aqueous polyol liquid preferably has the concentration of 20 mass % or more, more preferably 25 mass % or more, while preferably has the concentration of 65 mass % or less, more preferably 60 mass % or less. If the concentration is less than 20 mass %, the curing reaction between the aqueous polyol and the aqueous polyisocyanate tends to be slow. If the concentration is more than 65 mass %, the viscosity will be higher, resulting in the lower painting-workability.

The examples of aqueous polyol include aqueous polyester polyol: aqueous acrylic polyol=4:1(mass ratio, OH value: 66 mgKOH/g, acid number 25 mgKOH/g) available from SHINTO PAINT, and WG-6A available from Wayaku Paint Co., Ltd.

The aqueous polyisocyanate preferably used in the present invention is not limited, as long as the polyisocyanate is modified to be aqueous (water soluble or water dispersible). Examples of the aqueous polyisocyanate include an aqueous polyisocyanate modified with polyoxyalkylene ether alcohol (preferably polyoxyethylene ether alcohol). The polyisocyanate component constituting the aqueous polyisocyanate includes, for example, an aromatic polyisocyanate such as 2,4-tolylene diisocyanate, 2,6-tolylene diisocyanate, a mixture (TDI) of 2,4-tolylene diisocyanate and 2,6-tolylene diisocyanate, 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylenediisocyanate(TMXDI) and para-phenylene diisocyanate (PPDI); and an alicyclic or aliphatic polyisocyanate such as 4,4'-dicyclohexylmethane diisocyanate ($H_{12}$MDI), hydrogenated xylylenediisocyanate($H_6$XDI) hexamethylene diisocyanate (HDI), isophorone diisocyanate (IPDI), and norbornene diisocyanate(NBDI). The polyisocyanate can be used either alone or in combination of two or more. Among them, non-yellowing type polyisocyanates (HDI, $H_6$XDI, IPDI, $H_{12}$MDI, NBDI etc.) are preferable in view of weather resistance, and the aqueous hexamethylene diisocyanate is more preferable. Specific examples of the aqueous polyisocyanate are CR-60N available from DAINIPPON INK AND CHEMICALS, INC., Coronate C3062, C3053 available from NIPPON POLYURETHANE INDUSTRY, Bayhdur 3100 available from SUMITOMO BAYER URETHANE, I-3 available from SHINTO PAINT, and WG-6B available from Wayaku Paint Co., Ltd. As for the process for preparing the aqueous polyisocyanate, for example, the methods illustrated in Japanese unexamined patent publication No. H7-113005A, Japanese unexamined patent publication No. H9-71720A, Japanese unexamined patent publication No. 2003-246827A, Japanese unexamined patent publication No. H11-228653A, and Japanese unexamined patent publication No. H11-10042A may be employed.

In the curing paint used in the present invention, the mixing ratio (NCO/OH) of the aqueous polyisocyanate to the aqueous polyol is not limited. NCO/OH (molar ratio) is preferably not less than 1.3, more preferably not less than 1.4, even more preferably not less than 1.5, while the NCO/OH (molar ratio) is preferably not more than 2.5, more preferably not more than 2.3, even more preferably not more than 2.1. If NCO/OH (molar ratio) is less than 1.3, the curing reaction tends to be insufficient. The insufficient curing reaction causes the tackiness of the resulting paint film, thus the dust and the dirt tend to adhere to the resultant paint film. While if the molar ratio of NCO/OH is greater than 2.5, the residual isocyanate group tends to react with moisture, thereby generating $CO_2$. As a result, the air bubble tends to be contained in the paint film.

The curing paint used in the present invention may contain an aqueous polyamine in addition to the aqueous polyisocyanate and the aqueous polyol. Partly containing the aqueous polyamine, the curing paint preferentially makes the reaction between the aqueous polyisocyanate and the aqueous polyamine, thereby enabling to shorten the film-forming time (the time in which the tack of the paint film is lost). The aqueous polyamine is water-soluble or water-dispersible polyamine including, for example, an aliphatic polyamine such as ethylenediamine, propylenediamine, and hexamethylenediamine; an aromatic polyamine such as tolylenediamine, and xylylenediamine; a cycloaliphatic polyamine such as piperazine and isophoronediamine; and a dihydrazide or a derivative thereof such as hydrazine, succinic hydrazide, adipic hydrazide, and phthalic dihydrazide. In addition, an alkanolamine such as diethanolamine and monoethanolamine can be used as the polyamine.

The total amount of the solvent contained in the aqueous polyurethane paint used in the present invention is lowered as low as to 15 mass percent or less, more preferably 10 mass % or less, even more preferably 5 mass % or less, which is environment-friendly. The curing type urethane paint used in the present invention, as required, may further include an additive such as a pigment, an UV absorber, an antioxidant, a light-stabilizer, a fluorescent brightener, an anti-blocking agent, a leveling agent, and a slipping agent, which are conventionally used for the golf ball paint.

The process for preparing the painted golf ball according to the present invention is characterized in that the aqueous polycarbodiimide liquid is coated and subsequently the aqueous polyurethane paint is coated on the surface of the golf ball body. Particularly, it is preferable to dry the aqueous polycarbodiimide liquid coated on the golf ball body and subsequently apply the aqueous polyurethane paint thereon. In addition, the painted golf ball according to the present invention is a golf ball having a golf ball body, a primer layer comprising an aqueous polycarbodiimide coated on the surface of the golf ball body, and a paint film coated on the primer layer, wherein the paint film is formed by applying the aqueous polyurethane paint.

The process for applying the aqueous polycarbodiimide paint is not limited, and methods such as spray coating, dip coating and electrostatic coating may be employed. The aqueous liquid of the aqueous polycarbodiimide coated is preferably dried before the aqueous polyurethane paint is coated, thereby forming the primer layer comprising an aqueous polycarbodiimide on the surface of the golf ball body. In the process, it is not preferable that the aqueous liquid of the aqueous polycarbodiimide should contain any substance having a functional group with the reactivity against the carbodiimide group. If the carbodiimide group is consumed too much, the reactivity to the aqueous polyurethane paint which is subsequently coated may be lowered, possibly resulting in the lower adhesion between the paint film and the primer layer.

The aqueous liquid of the polycarbodiimide coated may be dried to the extent that the primer layer comprising the aqueous polycarbodiimide is formed, and the moisture derived from the aqueous liquid of the polycarbodiimide does not have to be removed completely. The aqueous liquid of the polycarbodiimide is preferably dried at the temperature of 30° C. or more, more preferably 35° C. or more, and preferably 80° C. or less, more preferably 70° C. or less for a period of 1 minute or more, preferably 3 minutes or more and 24 hours or less, more preferably 16 hours or less.

In the present invention, the aqueous polycarbodiimide is coated on the surface of the golf ball body before the aqueous polyurethane paint is coated. The process for applying the aqueous polyurethane paint is not limited, and methods such as spray coating, dip coating and electrostatic coating may be employed. In particular, when using the curing paint, it is also preferable to apply the aqueous polyol and the aqueous polyisocyanate separately in a spray coating method so that the applied ratio thereof becomes constant. The aqueous polyurethane paint coated on the golf ball, in the case of either one-component type or curing type, can be dried at a temperature of, for example, 30° C. to 70° C. for 1 to 24 hours to obtain the paint film.

The paint film after dried, without limitation, preferably has a thickness of not less than 5 μm, more preferably not less than 7 μm, and not more than 25 μm, more preferably not more than 18 μm. If the thickness is less than 5 μm, the paint film will be easily worn out by the continuous use. While if the thickness is more than 25 μm, the dimple will not work efficiently, thus the flying performance of the resultant golf ball tends to be low. In addition, the paint film may have a single layer structure or a multi layer structure having at least two layers, as long as the thickness of the paint film falls within the above range. The paint film preferably has the single layer structure, because the painting process can be simplified and the paint film in the present invention shows the excellent paint properties even in the single layer structure. Preferably, the paint film is the outermost clear paint layer.

The golf ball of the present invention has no limitation on its structure and includes a one-piece golf ball, a two-piece golf ball, a multi-piece golf ball comprising at least three layers, and a wound-core golf ball. The present invention can be applied to all types of the golf ball. Among them, preferred is a golf ball body comprising a cover such as the two-piece golf ball, the multi-piece golf ball or the wound-core golf ball, and a resin component constituting the cover preferably comprises a resin having a carboxyl group. In the case that the resin component constituting the cover has a carboxyl group, the aqueous polycarbodiimide reacts with both the carboxyl group of the resin constituting the cover and the carboxyl group of the aqueous polyurethane constituting the paint film. Thus, the cover and the paint film are bonded via a chemical bond. As a result, the adhesion of the paint film to the cover is getting higher. As the resin having the carboxyl group, an ionomer resin is preferably used. Examples of the ionomer resin are one prepared by neutralizing at least a part of carboxyl groups in a copolymer composed of ethylene and α,β-unsaturated carboxylic acid with a metal ion, and one prepared by neutralizing at least a part of carboxyl groups in a terpolymer composed of ethylene, α,β-unsaturated carboxylic acid and α,β-unsaturated carboxylic acid ester with a metal ion. Examples of the α,β-unsaturated carboxylic acid are acrylic acid, methacrylic acid, fumaric acid, maleic acid, and crotonic acid. Acrylic acid and methacrylic acid are preferable.

Examples of the α,β-unsaturated carboxylic acid ester are methyl ester, ethyl ester, propyl ester, n-butyl ester, isobutyl ester and the like of acrylic acid, and methacrylic acid. Especially, the ester of acrylic acid and methacrylic acid are preferable. The metal ion for neutralizing at least a part of the carboxyl groups includes an alkali metal ion such as sodium, potassium, and lithium; a divalent metal ion such as magnesium, calcium, zinc, barium, and cadmium; a trivalent metal ion such as aluminum, or other metal ions such as tin, and zirconium. Among them, sodium, zinc, and magnesium are preferably used to improve the resilience and the durability.

Examples of the ionomer resin include, but not limited to, HIMILAN 1555, HIMILAN 1557, HIMILAN 1605, HIMILAN 1652, HIMILAN 1702, HIMILAN 1705, HIMILAN 1706, HIMILAN 1707, HIMILAN 1855, HIMILAN 1856 available from MITSUI-DUPONT POLYCHEMICAL CO.; SURLYN 8945, SURLYN 9945, SURLYN 6320 available from DUPONT CO.; and IOTEK 7010, IOTEK 8000 available from Exxon Co. These ionomer resins may be used individually or as a mixture of two or more of them.

The base resin component constituting the cover may further include a thermoplastic elastomer, a diene type block copolymer and the like in addition to the above ionomer resin. Examples of the thermoplastic elastomer are a polyamide elastomer having a commercial name "PEBAX", for example "PEBAX 2533", available from ARKEMA Inc., a polyester elastomer having a commercial name of "HYTREL", for example "HYTREL 3548" and "HYTREL 4047" available from DU PONT-TORAY Co., and a polyurethane elastomer having a commercial name "ELLASTOLLAN", for example "ELLASTOLLAN XNY97A" and "ELLASTOLLAN XNY90A" available from BASF Japan Ltd.

The cover may further include a pigment such as zinc oxide, titanium oxide, and a blue pigment; a gravity adjusting agent such as calcium carbonate and barium sulfate; a dispersant, an antioxidant, an ultraviolet absorber, a light stabilizer, a fluorescent material, and a fluorescent brightener in addition to the above resin component, unless they impart any undesirable property to the cover.

In the following, a core of the wound-core golf ball, the two-piece golf ball, and the multi-piece golf ball or one-piece golf ball body will be explained. The conventional rubber composition can be used for the core and the one-piece golf ball body. For example, the core or the one-piece golf ball body can be molded by heat-pressing the rubber composition comprising a diene rubber as a base rubber, a co-crosslinking agent, and a crosslinking initiator.

Typically preferred as the diene rubber is the high cis-polybutadiene rubber having cis-1,4 bond in a proportion of not less than 40%, more preferably not less than 70%, even more preferably not less than 90%.

The co-crosslinking agent used in the present invention includes, for example, an α,β-unsaturated carboxylic acid or a metal salt thereof. Typically preferred is the α,β-unsaturated carboxylic acid having 3 to 8 carbon atoms such as acrylic acid and methacrylic acid or the metal salt thereof. As the metal forming the metal salt of the α,β-unsaturated carboxylic acid, a monovalent or divalent metal such as zinc, magnesium, calcium, aluminum and sodium is preferably used.

Among them, zinc is preferable, because it can impart the higher repulsion property to the golf ball. The amount of the co-crosslinking agent to be blended in the rubber composition is preferably not less than 20 parts by mass, more preferably not less than 25 parts by mass, and preferably not more than 50 parts by mass, more preferably not more than 40 parts by mass based on 100 parts by mass of the base rubber.

As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. The amount of the organic peroxide to be blended in the rubber composition is preferably not less than 0.2 part by mass, more preferably not less than 0.3 part by mass, and preferably not more than 1.5 parts by mass, more preferably not more than 1.0 part by mass based on 100 parts by mass of the base rubber. The rubber composition for the core and the one-piece golf ball body may further include a diphenyl disulfide or a derivative thereof. The amount of the diphenyl disulfide or the derivative thereof to be blended is preferably 0.1 parts or more, more preferably 0.3 parts or more, and is preferably 5.0 parts or less, more preferably 3.0 parts or less with respect to 100 parts by mass of the base rubber.

The rubber composition for the core and the one-piece golf ball body may further contain a specific gravity adjusting agent such as zinc oxide and barium sulfate, an antioxidant, a color powder, and the like, as required in addition to the base rubber, the co-crosslinking agent, the crosslinking initiator, and diphenyl disulfide or the derivative thereof.

The core is formed by press-molding the above rubber composition into the spherical body at the heating conditions. The conditions for the press-molding should be determined depending on the rubber composition. The press-molding is preferably carried out for 10 to 60 minutes at the temperature of 130 to 200° C. Alternatively, the press-molding is preferably carried out in a two-step heating, for example, for 20 to 40 minutes at the temperature of 130 to 150° C., and continuously for 5 to 15 minutes at the temperature of 160 to 180° C.

When preparing a multi-piece golf ball comprising at least three layers according to the present invention, the intermediate layer formed between the core and the cover includes, for example, a thermoplastic resin such as a polyurethane resin, an ionomer resin, Nylon, and a polyethylene; and a thermoplastic elastomer such as a polystyrene elastomer, a polyolefin elastomer, a polyurethane elastomer, a polyester elastomer, and a polyamide elastomer. Examples of the ionomer resin are one prepared by neutralizing at least a part of carboxyl groups in a copolymer composed of ethylene and α,β-unsaturated carboxylic acid with a metal ion, and one prepared by neutralizing at least a part of carboxyl groups in a terpolymer composed of ethylene, α,β-unsaturated carboxylic acid and α,β-unsaturated carboxylic acid ester with a metal ion. The intermediate layer may further include a gravity adjusting agent such as barium sulfate and tungsten, an antioxidant, a pigment and the like.

EXAMPLES

The following examples illustrate the present invention; however these examples are intended to illustrate the present invention and are not to be construed to limit the scope of the present invention. Many variations and modifications of such examples will exist without departing from the scope of the inventions. Such variations and modifications are intended to be within the scope of the present invention.

[Evaluation Method]

(1) Adhesion of the Paint Film

Each painted golf ball was hit 100 times repeatedly with a metal head driver (1 W) attached to a swing robot manufactured by TRUETEMPER CO, at the head speed of 45 m/sec. The peeling condition of the paint film was visually observed, and evaluated according to the following criteria.

E(Excellent): None of the paint film peeled off.

G(Good): The area where the paint film peeled off was not more than 5% with respect to the whole area of the paint film.

F(Fair): The area where the paint film peeled off was from 5% (exclusive) to 25% with respect to the whole area of the paint film.

P(Poor): The area where the paint film peeled off was more than 25% with respect to the whole area of the paint film.

(2) Wear-resistance of the Paint Film

Each painted golf ball was subjected to brushing wash for 1 hour in the potato peeler having the inside surface covered with the brush. The peeling condition of the paint film was visually observed, and evaluated according to the following criteria.

E(Excellent): None of the paint film peeled off.

G(Good): The area where the paint film peeled off was not more than 5% with respect to the whole area of the paint film.

F(Fair): The area where the paint film peeled off was from 5% (exclusive) to 25% with respect to the whole area of the paint film.

P(Poor): The area where the paint film peeled off was more than 25% with respect to the whole area of the paint film.

(3) Appearance of the Golf Ball

The appearance of the painted golf ball was observed by 10 amateur golfers, and the golf ball was evaluated in accordance with the following criteria. The answers which were obtained in the largest number were taken as the result of the observation according to the following criteria.

G(Good): The golf ball has sufficient gloss and a good appearance.

F(Fair): The golf ball has somewhat inferior gloss.

P(Poor): The golf ball has insufficient gloss and the appearance is bad.

[Production of the Golf Ball]

(1) Preparation of Solid Core

The rubber composition shown in Table 1 was kneaded and pressed with upper and lower molds each having a spherical cavity at the heating condition of 170° C. for 15 minutes to obtain the solid core in a spherical shape having a diameter of 39.3 mm.

TABLE 1

| Core formulation | Amount (Parts) |
|---|---|
| Polybutadiene rubber | 100 |
| Zinc acrylate | 33 |
| Zinc oxide | 5 |
| Barium sulfate | Appropriate amount |

TABLE 1-continued

| Core formulation | Amount (Parts) |
|---|---|
| Diphenyl disulfide | 0.5 |
| Dicumyl peroxide | 1 |

Notes on table 1
Polybutadiene rubber: BR-11 available from JSR.
Zinc acrylate: Sanceler SR available from Sanshin chemical Industry
Zinc oxide: "Ginrei R" produced by Toho-Zinc
Barium sulfate: Barium sulfate BD available from Sakai Chemical Industry Co., LTD.
Diphenyl disulfide: "Diphenyl disulfide" available from Sumitomo Seika Chemicals, Co.
Dicumyl peroxide: "Percumyl D" produced by NOF Corporation The amount of barium sulfate was appropriately adjusted to obtain the golf ball having a mass of 45.4 g in accordance with the cover composition.

(2) Preparation of the Cover Material

The materials shown in Table 2 were mixed using a twin-screw kneading extruder to obtain the cover composition in the form of pellet. The extrusion was conducted in the following conditions:

screw diameter=45 mm, screw revolutions=200 rpm, screw L/D=35, and the cover composition was heated to from 200° C. to 260° C. at the die position of the extruder.

TABLE 2

| Cover material | Cover material A | Cover material B |
|---|---|---|
| Himilan 1605 | 50 | — |
| Himilan 1706 | 50 | — |
| Ellastollan | — | 100 |

TABLE 2-continued

| Cover material | Cover material A | Cover material B |
|---|---|---|
| XNY97A | | |
| Titanium oxide | 4 | 4 |

Amount: parts
Notes on table 2
HIMILAN 1605: an ionomer resin of a sodium ion-neutralized ethylene-methacrylic acid copolymer, available from MITSUI-DUPONT POLYCHEMICAL
HIMILAN 1706: an ionomer resin of a zinc ion-neutralized ethylene-methacrylic acid copolymer, available from MITSUI-DUPONT POLYCHEMICAL
Ellastollan XNY97A: a thermoplastic polyurethane elastomer available from BASF Japan (3) Preparation of the Golf Ball Body The cover composition thus prepared was directly injection-molded onto the core to form the cover, thereby obtaining the two-piece golf ball body. The upper and lower molds for forming the cover have a spherical cavity with dimples. The part of the dimples can serve as a hold pin which is retractable. When forming the golf ball body, the hold pins were protruded to hold the core, and the resin heated at 210° C. was charged into the mold held under the pressure of 80 tons for 0.3 second. After the cooling for 30 seconds, the molds were opened and then the golf ball body was discharged. The obtained golf ball body was deburred, and as shown in Table 3, the aqueous liquid of the aqueous polycarbodiimide was coated on the surface of the golf ball body, and was dried at the temperature of 40° C. for 30 minutes to form the primer layer comprising the aqueous polycarbodiimide, and subsequently, the aqueous polyurethane paint was coated and dried to form the paint film. The aqueous polyurethane paint was dried at the temperature of 40° C. for 4 hours to obtain the golf ball having a diameter of 42.7 mm and a weight of 45.4 g. The obtained golf balls were evaluated in terms of the adhesion and the wear-resistance of the paint film. The results were also shown in Table 3.

TABLE 3

| | Golf Ball No. | | | | | | | | | | |
|---|---|---|---|---|---|---|---|---|---|---|---|
| | No. 1 | No. 2 | No. 3 | No. 4 | No. 5 | No. 6 | No. 7 | No. 8 | No. 9 | No. 10 | No. 11 |
| Cover Material | A | A | A | A | B | A | A | A | A | A | A |
| Carbodiimide Treatment | Yes | Yes | Yes | Yes | Yes | Yes | Yes | Yes | No | No | Yes |
| Concentration of Aqueous polycarbodiimide (mass %) | 0.5 | 1 | 3 | 5 | 5 | 10 | 30 | 40 | — | — | — |
| Concentration of oil-based polycarbodiimide (mass %) | — | — | — | — | — | — | — | — | — | — | 5 |
| Aqueous paint | — | — | — | — | — | — | — | — | — | — | — |
| Aqueous polyol | 100 | 100 | 100 | 100 | 100 | 100 | 100 | 100 | 100 | 100 | 100 |
| Aqueous polyisocyanate | 24 | 24 | 24 | 24 | 24 | 24 | 24 | 24 | 24 | 24 | 24 |
| Aqueous polycarbodiimide | — | — | — | — | — | — | — | — | — | 5 | — |
| NCO/OH molar ratio | 1.5 | 1.5 | 1.5 | 1.5 | 1.5 | 1.5 | 1.5 | 1.5 | 1.5 | 1.5 | 1.5 |
| Evaluation | — | — | — | — | — | — | — | — | — | — | — |
| Appearance of the golf ball | G | G | G | G | G | G | G | F | G | G | G |
| Adhesion of the paint film | G | G | E | E | E | E | E | E | P | P | P |

TABLE 3-continued

| | Golf Ball No. | | | | | | | | | | |
|---|---|---|---|---|---|---|---|---|---|---|---|
| | No. 1 | No. 2 | No. 3 | No. 4 | No. 5 | No. 6 | No. 7 | No. 8 | No. 9 | No. 10 | No. 11 |
| Wear-resistance of the paint film | G | E | E | E | E | E | E | E | F | F | F |

Formulation: parts (wet base)
Notes on table 3
Aqueous polyol: aqueous polyester polyol/aqueous acrylic polyol = 4/1 (mass ratio, OH value: 66 mgKOH/g, acid number 25 mgKOH/g) available from SHINTO PAINT
Aqueous polyisocyanate: aqueous hexamethylene diisocyanate (dissolved in 3-methoxybutyl acetate, solid content of 75 mass %)available from SHITO PAINT
aqueous liquid of the aqueous polycarbodiimide: Aqueous polycarbodiimide: an aqueous dispersion of the polycarbodiimide having a carbodiimide equivalent of 385 and solid content of 40 mass %, available from NISSHINBO INDUTRIES INC.

Golf balls No. 1 to No. 6 were obtained by coating the aqueous polycarbodiimide on the surface of the golf ball body, drying to form the primer layer comprising the aqueous polycarbodiimide, and subsequently applying the aqueous polyurethane paint to form the paint film. All of the golf balls showed the good results in terms of the appearance, adhesion, and wear-resistance. Golf balls No. 9 to No. 10 did not have the primer layer comprising aqueous polycarbodiimide formed thereon. In either case, the adhesion to the paint film was lowered.

The present invention has been achieved in view of the above circumstances. The object of the present invention is to provide a golf ball having a paint film which is obtained from an environment-friendly aqueous paint and is excellent in the adhesion.

According to the present invention, it is possible to reduce the amount of the organic solvent contained in the aqueous paint used for production of a golf ball. In addition, the paint film of the painted golf ball obtained is excellent in adhesion and wear-resistance.

This application is based on Japanese Patent application No.2,005-339,393 filed on Nov. 24, 2005, the contents of which are hereby incorporated by reference.

What is claimed is:

1. A method for preparing a painted golf ball, comprising, coating an aqueous liquid of an aqueous polycarbodiimide, and subsequently coating an aqueous polyurethane paint on a surface of a golf ball body and wherein a curing paint is used as the aqueous polyurethane paint and the curing paint contains an aqueous polyisocyanate and an aqueous polyol having at least one carboxyl group in the molecule thereof and an acid number from 10 mgKOH/g to 50 mg KOH/g.

2. The method for preparing the painted golf ball according to claim 1, further comprising, drying the aqueous liquid of the aqueous polycarbodiimide coated on the surface of the golf ball body before coating the aqueous polyurethane paint.

3. The method for preparing the painted golf ball according to claim 1, wherein the aqueous polycarbodiimide is an aqueous polycarbodiimide resin represented by the following chemical formula (1)

(1)

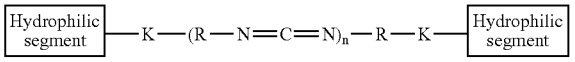

wherein R is a residue where isocyanate groups are removed from diisocyanate, K is a bond formed by a reaction of an isocyanate group and a hydrophilic segment, and "n" has an average degree of polymerization and is an integer ranging from 2 to 100.

4. The method for preparing the painted golf ball according to claim 1, wherein the aqueous polycarbodiimide has a carbodiimide equivalent from 100 to 700.

5. The method for preparing the painted golf ball according to claim 1, wherein the aqueous polycarbodiimide has a carbodiimide equivalent from 250 to 600.

6. A method for preparing a painted golf ball, comprising, coating an aqueous liquid of an aqueous of an aqueous polycarbodiimide, and subsequently coating an aqueous polyurethane paint on a surface of a golf ball body, and wherein a one-component aqueous polyurethane paint having a carboxyl group is used as the aqueous polyurethane paint and, the one-component aqueous polyurethane has an acid number from 10 mg KOH/g to 60 mg KOH/g.

7. The method for preparing the painted golf ball according to claim 6, further comprising, drying the aqueous liquid of the aqueous polycarbodiimide coated on the surface of the golf ball body before coating the aqueous polyurethane paint.

8. The method for preparing the painted golf ball according to claim 6, wherein the aqueous polycarbodiimide is an aqueous polycarbodiimide resin represented by the following chemical formula (1)

(1)

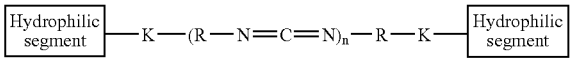

wherein R is a residue where isocyanate groups are removed from diisocyanate, K is a bond formed by a reaction of an isocyanate group and a hydrophilic segment, and "n" has an average degree of polymerization and is an integer ranging from 2 to 100.

9. The method for preparing the painted golf ball according to claim 6, wherein the aqueous polycarbodiimide has a carbodiimide equivalent from 100 to 700.

10. The method for preparing the painted golf ball according to claim 6, wherein the aqueous polycarbodiimide has a carbodiimide equivalent from 250 to 600.

11. A painted golf ball comprising, a golf ball body, a primer layer comprising an aqueous polycarbodiimide and covering a surface of a golf ball body, a paint film covering the primer layer, wherein the paint film is formed by applying an aqueous polyurethane paint, and wherein the aqueous polyurethane paint is a curing paint containing an aqueous polyisocyanate and an aqueous polyol having at least one carboxyl group in the molecule thereof and an acid number from 10 mg KOH/g to 50 mg KOH/g.

12. The painted golf ball according to claim 11, wherein the aqueous polycarbodiimide is an aqueous polycarbodiimide resin represented by the following chemical formula (1)

(1)

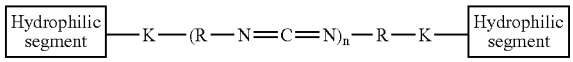

wherein R is a residue where isocyanate groups are removed from diisocyanate, K is a bond formed by a reaction of an isocyanate group and a hydrophilic segment, and "n" has an average degree of polymerization and is an integer ranging from 2 to 100.

13. The painted golf ball according to claim 11, wherein the aqueous polycarbodiimide has a carbodiimide equivalent from 100 to 700.

14. The painted golf ball according to claim 11, wherein the paint film has a single layer structure.

15. The painted golf ball according to claim 11, wherein the golf ball body comprises a cover, and the cover comprises a resin having a carboxyl group.

16. A painted golf ball comprising, a golf ball body, a primer layer comprising an aqueous polycarbodiimide and a covering a surface of a golf ball body, a paint film covering the primer layer, wherein the paint film is formed by applying an aqueous polyurethane paint, and wherein the aqueous polyurethane paint is a one-component aqueous polyurethane having a carboxyl group and an acid number from 10 mg KOH/g to 60 mg KOH/g.

17. The painted golf ball according to claim 16, wherein the aqueous polycarbodiimide is an aqueous polycarbodiimide resin represented by the following chemical formula (1)

(1)

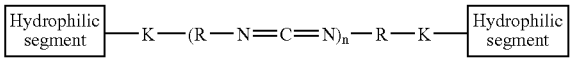

wherein R is a residue where isocyanate groups are removed from diisocyanate, K means a bond formed by a reaction of an isocyanate group and a hydrophilic segment, and "n" has an average degree of polymerization and is an integer ranging from 2 to 100.

18. The painted golf ball according to claim 16, wherein the aqueous polycarbodiimide has a carbodiimide equivalent from 100 to 700.

19. The painted golf ball according to claim 16, wherein the paint film has a single layer structure.

20. The painted golf ball according to claim 16, wherein the golf ball body comprises a cover, and the cover comprises a resin having a carboxyl group.

* * * * *